US008257171B2

(12) United States Patent
Gagner et al.

(10) Patent No.: US 8,257,171 B2
(45) Date of Patent: Sep. 4, 2012

(54) SECURE MODE CONTROL IN WAGERING GAME SYSTEMS

(75) Inventors: Mark B. Gagner, West Chicago, IL (US); Jorge L. Shimabukuro, Las Vegas, NV (US); Craig J. Sylla, Round Lake, IL (US)

(73) Assignee: WMS Gaming, Inc., Waukegan, IL (US)

( * ) Notice: Subject to any disclaimer, the term of this patent is extended or adjusted under 35 U.S.C. 154(b) by 248 days.

(21) Appl. No.: 12/675,738

(22) PCT Filed: Aug. 27, 2008

(86) PCT No.: PCT/US2008/074522

§ 371 (c)(1),
(2), (4) Date: Feb. 26, 2010

(87) PCT Pub. No.: WO2009/029687

PCT Pub. Date: Mar. 5, 2009

(65) Prior Publication Data

US 2010/0234100 A1 Sep. 16, 2010

Related U.S. Application Data

(60) Provisional application No. 60/968,473, filed on Aug. 28, 2007.

(51) Int. Cl.
*A63F 9/24* (2006.01)

(52) U.S. Cl. ..... 463/29; 463/42

(58) Field of Classification Search ..... 463/29, 463/42

See application file for complete search history.

(56) References Cited

U.S. PATENT DOCUMENTS

| | | | | |
|---|---|---|---|---|
| 6,251,014 | B1 | 6/2001 | Stockdale et al. | |
| 6,846,238 | B2 | 1/2005 | Wells | |
| 2003/0008659 | A1 * | 1/2003 | Waters et al. | 455/456 |
| 2003/0104865 | A1 | 6/2003 | Itkis et al. | |
| 2005/0130728 | A1 | 6/2005 | Nguyen et al. | |
| 2006/0035713 | A1 | 2/2006 | Cockerille et al. | |
| 2006/0128460 | A1 | 6/2006 | Muir et al. | |
| 2006/0281541 | A1 | 12/2006 | Nguyen et al. | |

(Continued)

FOREIGN PATENT DOCUMENTS

WO 2007/008599 A2 * 1/2007

(Continued)

OTHER PUBLICATIONS

Wang et al., "Issues related to Development of Wireless Peer-to-Peer Games in J2ME", Proceedings of the Advanced International Conference on Telecommunications and International Conference on Internet and Web Applications and Services (AICT/ICIW 2006), IEEE Computer Society, 2006, 6 pages.*

(Continued)

*Primary Examiner* — James D Nigh
(74) *Attorney, Agent, or Firm* — DeLizio Gilliam, PLLC

(57) ABSTRACT

A secure mode control device is described herein. The secure mode control device interfaces with a wagering game machine. The wagering game machine is capable of secure modes. The wagering game machine is also capable of wagering game modes that can generate wagering game data. The secure mode control device can detect an event that indicates a need for the wagering game machine to activate a secure mode. The secure mode control device activates the secure mode to halt the one or more wagering game modes on the wagering game machine.

23 Claims, 13 Drawing Sheets

U.S. PATENT DOCUMENTS

| | | | | |
|---|---|---|---|---|
| 2007/0045959 | A1 | 3/2007 | Soltys | |
| 2007/0117608 | A1 | 5/2007 | Roper et al. | |
| 2008/0076572 | A1 * | 3/2008 | Nguyen et al. | 463/42 |
| 2010/0222141 | A1 | 9/2010 | LaSalvia et al. | |

FOREIGN PATENT DOCUMENTS

| | | |
|---|---|---|
| WO | WO-2009006363 | 1/2009 |

OTHER PUBLICATIONS

"PCT Application No. PCT/US2008/074522 International Preliminary Report on Patentability", Jul. 28, 2010, 6 pages.

"PCT Application No. PCT/US08/74522 International Search Report", Nov. 18, 2008, 9 pages.

"PCT Application No. PCT/US2008/068702 International Preliminary Report on Patentability", Sep. 8, 2009, 12 pages.

"PCT Application No. PCT/US2008/068702 International Preliminary Report on Patentability", Jan. 14, 2010, 7 pages.

"PCT Application No. PCT/US2008/068702 International Search Report", Oct. 10, 2009, 10 pages.

"PCT Application No. PCT/US2008/074522 International Preliminary Report on Patentability", Sep. 15, 2010, 6 pages.

"U.S. Appl. No. 12/663,647 Office Action", Oct. 6, 2011, 15 pages.

* cited by examiner

SECURE MODE CONTROL IN WAGERING GAME SYSTEMS

RELATED APPLICATIONS

This application claims the priority benefit of U.S. Provisional Application Ser. No. 60/968,473 filed Aug. 28, 2007.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, WMS Gaming, Inc.

FIELD

Embodiments of the inventive subject matter relate generally to controlling modes in wagering game systems, and more particularly to devices that control secure modes in wagering game systems and networks.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator.

SUMMARY

In some embodiments, a method comprises interfacing with a wagering game machine, the wagering game machine being capable of at least one secure mode, and one or more wagering game modes that cause generation of wagering game data; detecting an event that indicates a need for the wagering game machine to activate the at least one secure mode; and activating the at least one secure mode to halt the one or more wagering game modes on the wagering game machine.

In some embodiments, the secure mode prevents the generation of wagering game data.

In some embodiments, the method further comprises determining, based on the event, a security level of the at least one secure mode; and enabling, based on the security level, the at least one secure mode.

In some embodiments, the event is a user-activated procedure to initiate the at least one secure mode, and further comprises authorizing the user-activated procedure.

In some embodiments, activating the at least one secure mode includes performing operations on the wagering game machine, the operations including one or more selected from the group consisting of preventing the wagering game machine from writing and generating data, erasing data on the wagering game machine, erasing software and firmware on the wagering game machine, disabling hardware on the wagering game machine, providing environmental cues, and transferring data to a server device.

In some embodiments, activating the at least one secure mode further comprises interfacing with a network device; and transferring wagering game data from the wagering game machine to the network device.

In some embodiments, activating the at least one secure mode further comprises generating at least one secure mode control command; and communicating the at least one secure mode control command to the wagering game machine.

In some embodiments, the method further comprises determining whether the at least one secure mode can be deactivated; and deactivating the at least one secure mode to re-enable the one or more wagering game functional modes.

In some embodiments, a wagering game network comprises a wagering game machine configured to operate in a plurality of operational modes; and a security mode control device configured to interface with the wagering game machine, the security mode control device includes, a security event detector configured to detect any one of a plurality of events occurring on the wagering game network, wherein the events indicate a need for the wagering game machine to activate any one of a plurality of secure modes; and a security mode controller to activate any one of the plurality of secure modes.

In some embodiments, the security mode control device is configured to prevent the operation of wagering games on the wagering game machine.

In some embodiments, the wagering game machine is a mobile model.

In some embodiments, the plurality of events are classifiable by severity types indicating degrees of needed security, and wherein the security mode controller is further configured to determine the severity types of the plurality of events and activate the plurality of security modes according to levels of security.

In some embodiments, the wagering game network further comprises an electronic information security controller configured to secure electronic information on the wagering game machine, including locking and erasing data, software, firmware, memory, bios configurations, operating systems, system configurations, or files.

In some embodiments, the security mode control device is configured to transfer wagering game data from the wagering game machine to a network device.

In some embodiments, a machine-readable medium can include instructions executable by a machine. In some embodiments, the instructions comprise instructions to detect a security event that occurs on a wagering game network, wherein the security event requires a wagering game machine to activate a secure operational mode, the secure operational mode to prevent the operation of wagering game activity on the wagering game machine; and instructions to activate the secure operational mode on the wagering game machine.

In some embodiments, the wagering game machine is a mobile wagering game machine.

In some embodiments, the machine-readable medium further comprises instructions to erase or destroy any one of electronic information or hardware on the wagering game machine.

In some embodiments, the machine-readable medium further comprises instructions to determine the severity of the security event; instructions to determine a level of security, based on the severity of the security event; and instructions to select the secure operational mode according to the level of security.

In some embodiments, the machine-readable medium further comprises instructions to authorize activation the secure operational mode.

In some embodiments, the machine-readable medium further comprises instructions to deactivate the secure operational mode.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into four sections. The first section provides an introduction to embodiments of the invention, while the second section describes example operating environments. The third section describes example operations performed by some embodiments. The fourth section presents some general comments.

INTRODUCTION

This section provides an introduction to some embodiments of the invention.

In the gaming industry, casino patrons benefit from devices that make gaming fun and easy. One of these devices is the mobile wagering game machine ("mobile machine"). The gaming patron can carry a mobile machine around a casino. The patron can select and play games on the mobile machine, anywhere on the casino floor. A mobile machine can also provide uses other than game playing that assist the gaming patron in their gaming experience. Some uses can include providing information, perks, assistance, and other services provided by the casino. Depending on the information, service, or entertainment provided via the mobile machine, the mobile machine's operation may vary. In other words, the mobile machine can have numerous differing operational modes ("modes").

Figure 1:
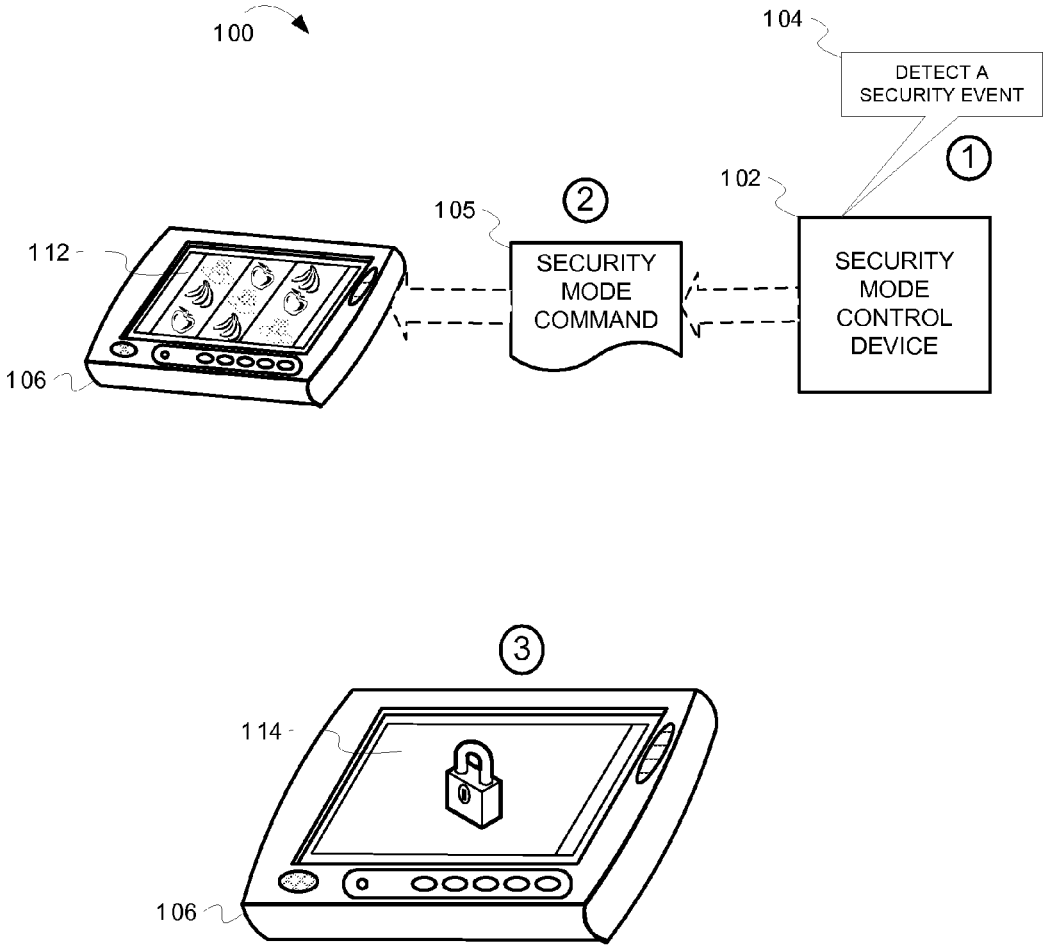
FIG. 1 shows how some embodiments of a security mode control device can work with a mobile machine to secure and protect the mobile machine by using secure operational modes ("secure modes")

Mobile machines represent a significant investment for casinos. The software and data on the machines is very valuable and needs protection. However, because the mobile machines are mobile, some people have attempted to remove mobile machines from casinos. Some people have attempted to open up mobile machines to tamper with the mobile machine components and data. In other circumstances, a mobile machine requires safeguards to protect critical wagering game data at important times, like after jackpot wins or before power failures. FIG. 1 shows how some embodiments of a security mode control device can work with a mobile machine to secure and protect the mobile machine by using secure operational modes ("secure modes").

In FIG. 1, the security mode control device 102 detects the need for a secure mode. For example, at stage "1", the security mode control device 102 detects a security event 104 that indicates a need to secure the mobile machine. The security event 104 can be created by many different devices or methods. The security event 104 can represent many different security related occurrences. The following non-exhaustive list enumerates some example security events:

- an authorized user manually activates a process to lock a wagering game machine, such as via password, physical key, electronic key, etc.;
- a user wins a jackpot on the mobile machine and a security mode control device needs to secure the data on the mobile wagering game machine to ensure data integrity;
- a unauthorized user or device attempts a machine hack, a network hack, or other types of rogue code intrusion or tampering;
- the mobile machine leaves a designated area without authorization;
- an unauthorized user or device physically tampers with the mobile machine;
- communication terminates between mobile machine and network server;
- a mobile machine malfunctions; or
- a mobile machine becomes critically low on power.

In FIG. 1, the security mode control device 102 can create a security mode command 105, as shown at stage "2". The security mode control device 102 can transmit the security mode command 105 to the mobile machine 106. If the mobile machine 106 is currently operating in a functional mode, such as a game playing mode 112, the security mode command 105 can secure the mobile machine 106, shown at stage "3", by activating a secure mode 114. In some embodiments, the secure mode control device 102 activates a recoverable secure mode, meaning that the secure mode control device 102 can disable the secure mode 114 so that the mobile machine 106 can return to some level of functionality. In other cases, the security mode control device 102 device activates a secure mode 114 that is not recoverable (i.e., the mobile machine is permanently disabled).

The description below will describe in more detail how the security mode control device 102 secures the mobile machine 106 with secure modes. The description below will also describe possible ways the security mode control device 102 can disable a secure mode 114 so that the machine can continue to be used for wagering game activities.

Although FIG. 1 describes some embodiments, the following sections describe many other features and embodiments.

Example Operating Environments

This section describes example operating environments and networks and presents structural aspects of some embodiments. More specifically, this section includes discussion about wagering game networks, security mode control device architectures, wagering game machine architectures, security mode control device example operating environments, security mode control device example operating environments, security mode control device example operating environments, security mode control device example operating environments, and mobile wagering game machines.

Example Wagering Game Network

Figure 2:
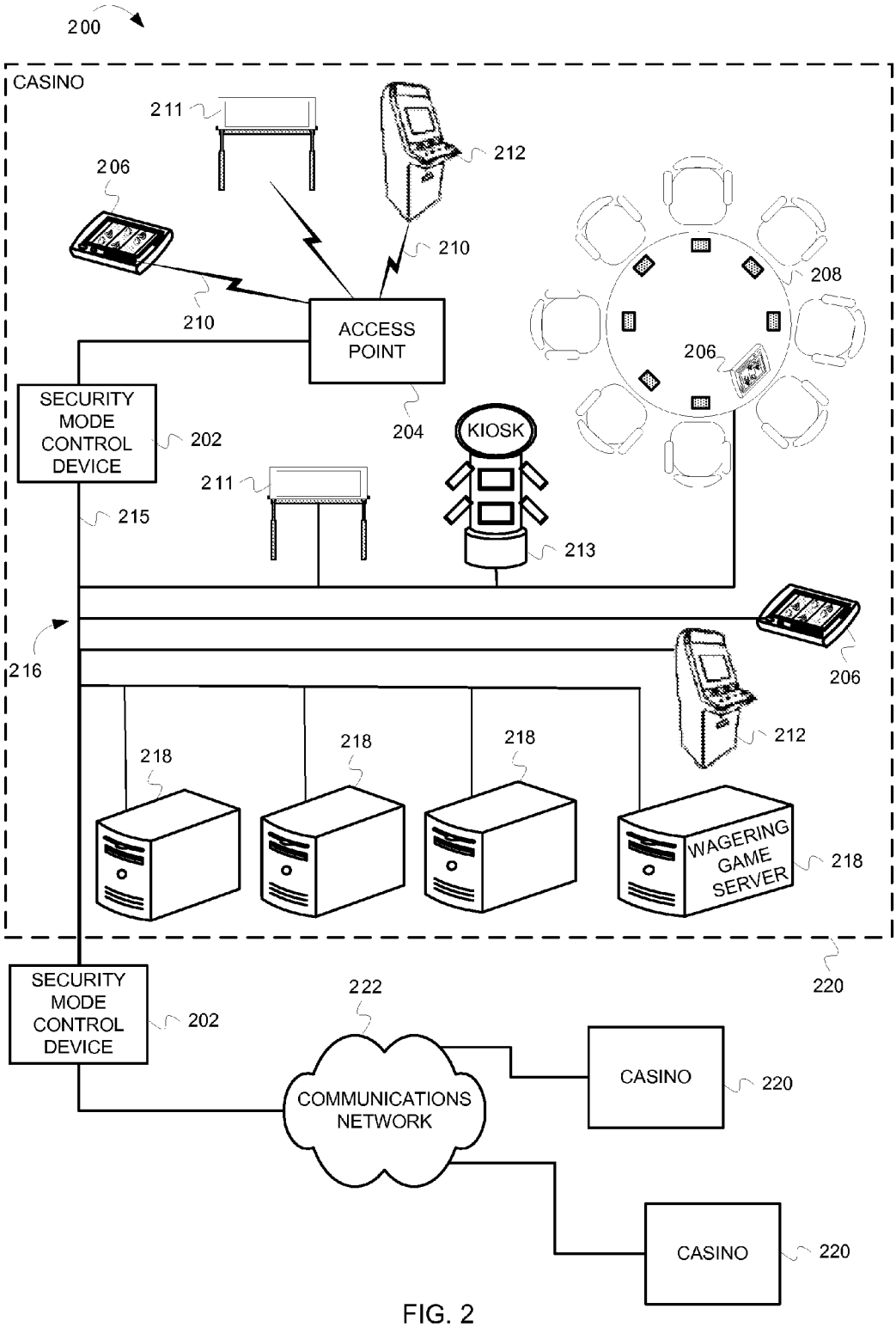
FIG. 2 is an illustration of a wagering game network 200, according to some embodiments of the invention.

FIG. 2 is an illustration of a wagering game network 200, according to some embodiments of the invention. In FIG. 2, the wagering game network 200 includes a plurality of casinos 220 connected to a communications network 222. Each casino 220 includes a local area network 216, which includes an access point 204, one or more servers 218, and wagering game machines 206, 211, 212. In one embodiment, the local area network 216 may also include specific types of servers 218, such as a wagering game server, a promotions server, a player information server, a management server, or other servers not shown herein, such as social networking servers, progressive servers, player tracking servers, file servers, web servers, application servers, database servers, and casino and player account servers. There are many other devices, in other embodiments, that are not shown but that may exist in a wagering game network (e.g., routers, switches, monitoring equipment, etc.). The access point 204 provides wireless communication links 210 with wagering game machines 206, 211, 212. The local area network 216 may also include wired communication links 215 to connect to servers 218, access point 204, wagering game machines 206, 211, 212, one or more docking stations 208 and one or more kiosks 213 for storing mobile machines. The wired and wireless communication links can employ any suitable connection technology, such as Bluetooth, 801.11, Ethernet, public switched telephone networks, SONET, etc. In some embodiments, the servers 218 can serve wagering games and distribute content to devices located in other casinos 220 or at other locations on the communications network 222.

The wagering game machines 206, 211, 212 described herein can take any suitable form, such as floor standing models (e.g., 212), handheld mobile units (e.g., 206), bar-top models, workstation-type console models, surface computing machines (e.g., 211), etc. Further, the wagering game machines 206, 212 can be primarily dedicated for use in conducting wagering games, or can include non-dedicated devices, such as mobile phones, personal digital assistants, personal computers, etc.

In some embodiments, wagering game machines 206, 211, 212 and wagering game servers 218 work together such that wagering game machines 206, 211, 212 can be operated as a thin, thick, or intermediate client. For example, one or more elements of game play may be controlled by the wagering game machines 206, 212 (client) or the wagering game servers 218 (server). Game play elements can include executable game code, lookup tables, configuration files, game outcome, audio or visual representations of the game, game assets or the like. In a thin-client example, the wagering game server 218 can perform functions such as determining game outcome or managing assets, while the wagering game machines 206, 211, 212 can present a graphical representation of such outcome or asset modification to the user (e.g., player). In a thick-client example, the wagering game machines 206, 211, 212 can determine game outcomes and communicate the outcomes to the wagering game server 218 for recording or managing a player's account.

In some embodiments, either the wagering game machines 206, 211, 212 (client) or the wagering game server(s) 218 can provide functionality that is not directly related to game play. For example, account transactions and account rules may be managed centrally (e.g., by the wagering game server(s) 218) or locally (e.g., by the wagering game machines 206, 211, 212). Other functionality not directly related to game play may include power management, presentation of advertising, software or firmware updates, system quality or security checks, etc.

The wagering game network 200 also includes one or more security mode control devices 202. The security mode control device 202 can control secure modes on a wagering network device. The security mode control device 202 may be internal or external to a casino 220 and may interact with any suitable wagering game network component to control secure modes on a wagering network device.

Any of the wagering game network components (e.g., the wagering game machines 206, 211, 212) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Security Mode Control Device Architecture

Figure 3:
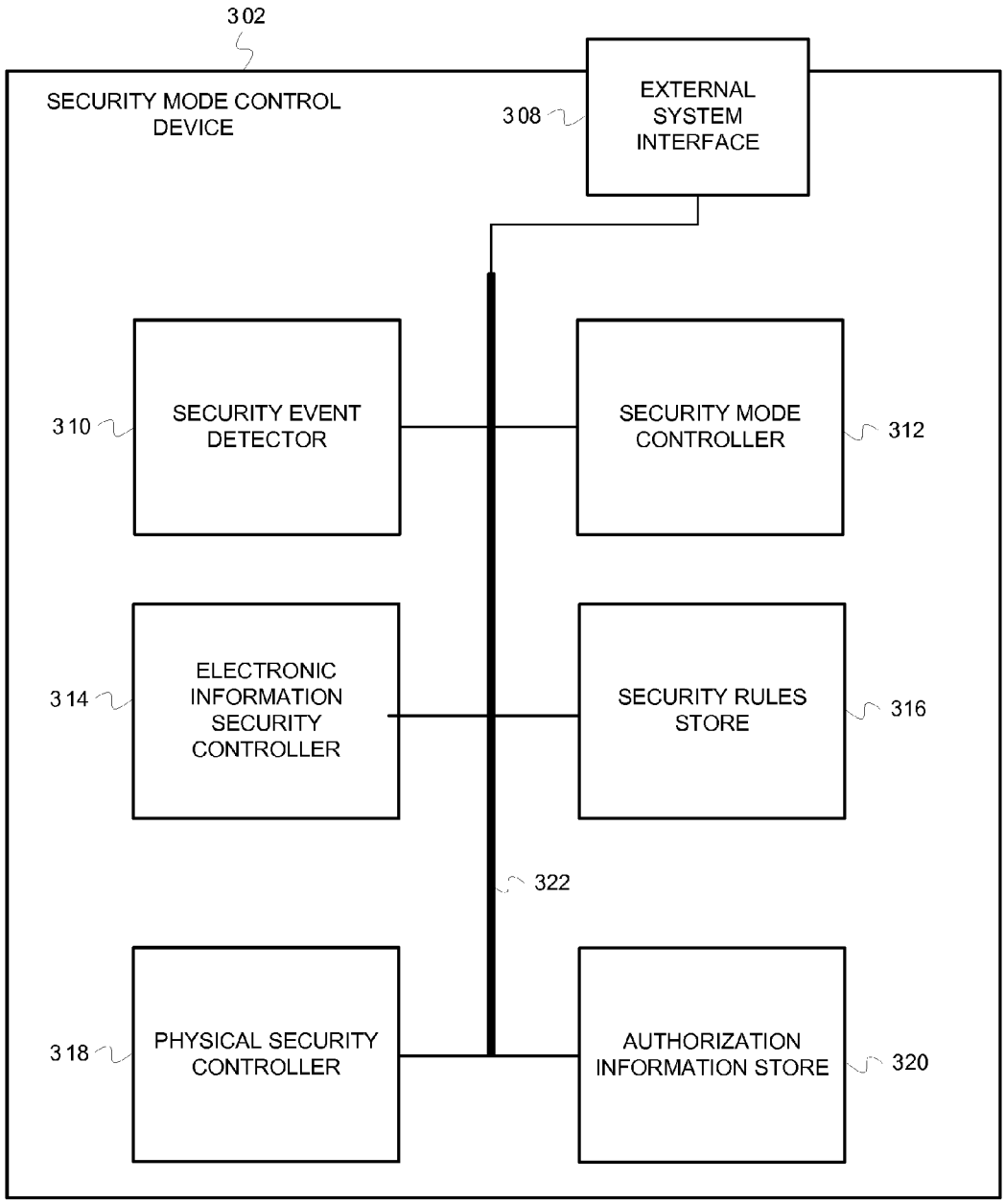
FIG. 3 is an illustration of a security mode control device architecture 300, according to some embodiments of the invention.

FIG. 3 is an illustration of a security mode control device architecture 300, according to some embodiments of the invention. In FIG. 3, the security mode control device architecture 300 includes a security event detector 310 configured to detect a security event that occurs on a wagering game network. The security event indicates a need for a wagering game machine to activate a secure mode. The event can be classified by a severity type indicating a degree of needed security. Therefore, in some embodiments, the security detector is configured to determine a level of security for the secure mode based on the event's severity type.

In FIG. 3, the security mode control device architecture 300 also includes a security mode controller 312 configured to activate and deactivate secure modes, and prevent mode conflicts. In some embodiments, the security mode controller 312 creates secure mode control commands that the security mode control device 302 can transmit to a wagering game machine. Furthermore, the security mode controller 312 is configured to activate secure modes based on security levels that the security event detector 310 determines.

In FIG. 3, the security mode control device architecture 300 also includes an electronic information security controller 314 configured to secure electronic information from the machine. The electronic information security controller 314 can lock, modify or erase electronic information, including any one of the following: data, software, firmware, memory, bios configurations, operating systems, system configurations, files, etc. The electronic information security controller 314 is also configured to prevent a wagering game machine from writing and generating data while the wagering game machine is operating in a secure mode.

In FIG. 3, the security mode control device architecture 300 also includes a security rules store 316 configured to store rules needed to control secure modes. The security rules store 316 can store rules regarding types of security events, rules regarding severity of event types, rules regarding security levels of secure modes, rules regarding mode conflict, etc. In other words, the security rules store 316 stores any rules regarding any process or criteria that the security mode control device 302 needs to reference to secure the wagering game machine.

In FIG. 3, the security mode control device architecture 300 also includes a physical security controller 318. The physical security controller 318 is configured to control the state of physical components of a device that is interfaced with the security mode control device 302. In some embodiments, the physical security controller 318 works in conjunction with other security devices on a mobile wagering game machine, such as the shell security module 818 in FIG. 8.

In FIG. 3, the security mode control device architecture 300 also includes an authorization information store 320. The authorization information store 320 is configured to store unique identification information that the secure mode controller 312 can use to authorize secure modes, secure mode control commands, etc. Unique identification information can include user account names, passwords, security keys, serial numbers, media access control addresses, etc.

In FIG. 3, the security mode control device architecture 300 also includes an external system interface 308. The external system interface 308 is configured to interface with devices and systems external to the security mode control device 302. The external system interface 308 can be configured to interface with wired and wireless devices and systems.

In FIG. 3, the security mode control device architecture 300 also includes an internal communication interface 322. The communication interface 322 is configured to facilitate communication between components of the security mode control device 302.

Example Wagering Game Machine Architecture

Figure 4:
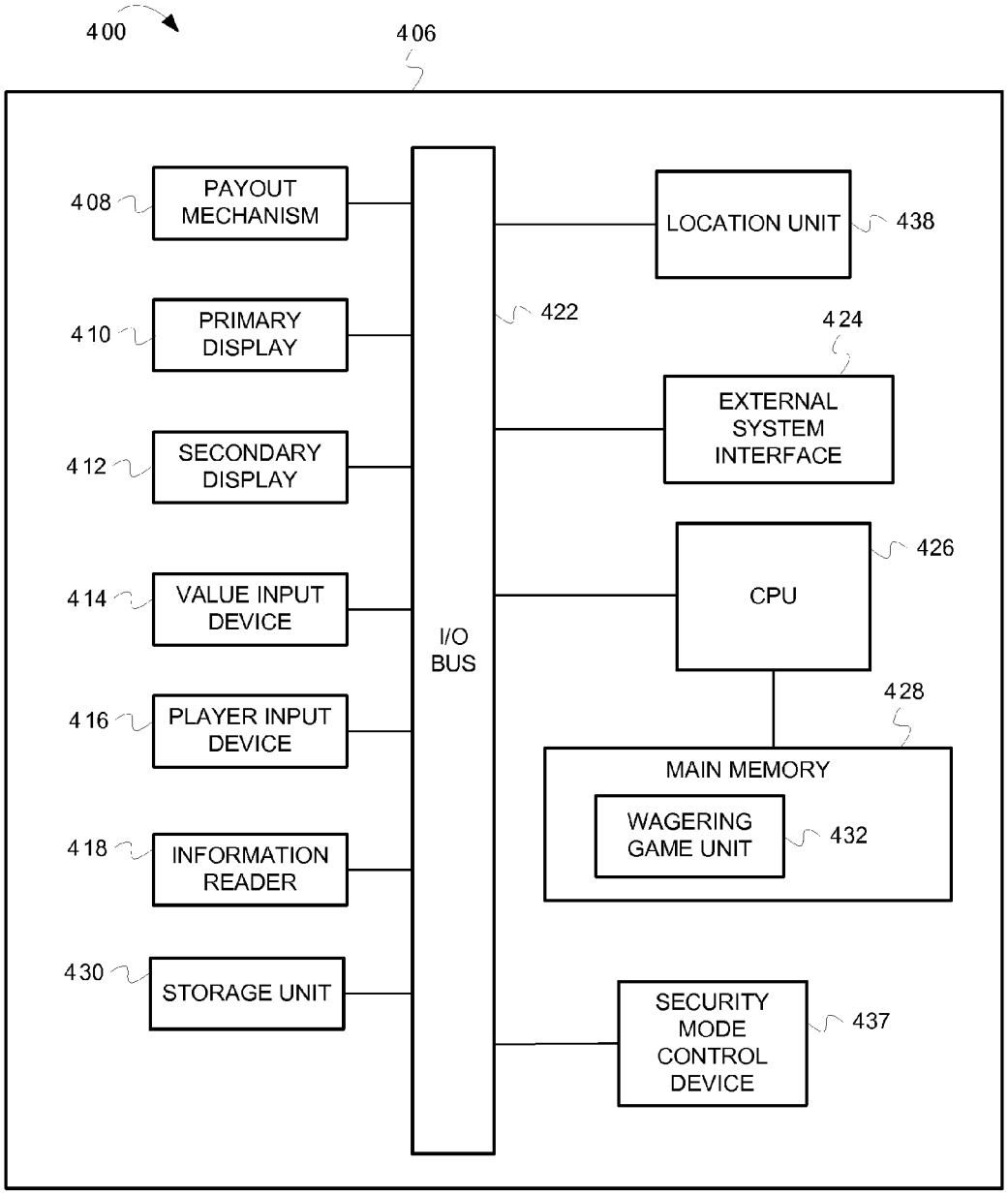
FIG. 4 is an illustration of a wagering game machine architecture 400, according to some embodiments of the invention.

FIG. 4 is an illustration of a wagering game machine architecture 400, according to some embodiments of the invention. In FIG. 4, the wagering game machine architecture 400 includes a wagering game machine 406, which includes a central processing unit (CPU) 426 connected to main memory 428. The CPU 426 can include any suitable processor, such as an Intel® Pentium processor, Intel® Core 2 Duo processor, AMD Opteron™ processor, or UltraSPARC processor. The main memory 428 includes a wagering game unit 432. In one embodiment, the wagering game unit 432 can present wagering games, such as video poker, video black jack, video slots, video lottery, reel slots, etc., in whole or part.

The CPU 426 is also connected to an input/output ("I/O") bus 422, which can include any suitable bus technologies, such as an AGTL+ frontside bus and a PCI backside bus. The I/O bus 422 is connected to a payout mechanism 408, primary display 410, secondary display 412, value input device 414, player input device 416, information reader 418, and storage unit 430. The player input device 416 can include the value input device 414 to the extent the player input device 416 is used to place wagers. The I/O bus 422 is also connected to an external system interface 424, which is connected to external systems 404 (e.g., wagering game networks). The external system interface 424 can include logic for exchanging information over wired and wireless networks (e.g., 802.11g transceiver, Bluetooth transceiver, Ethernet transceiver, etc.)

The I/O bus 422 is also connected to a location unit 438. The location unit 438 can create player information that indicates the wagering game machine's location/movements in a casino. In some embodiments, the location unit 438 includes a global positioning system (GPS) receiver that can determine the wagering game machine's location using GPS satellites. In other embodiments, the location unit 438 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 4, in some embodiments, the location unit 438 is not connected to the I/O bus 422.

In one embodiment, the wagering game machine 406 can include additional peripheral devices and/or more than one of each component shown in FIG. 4. For example, in one embodiment, the wagering game machine 406 can include multiple external system interfaces 424 and/or multiple CPUs 426. In one embodiment, any of the components can be integrated or subdivided.

In one embodiment, the wagering game machine 406 includes a security mode control device 437. The security mode control device 437 can process communications, commands, or other information, that can control secure modes on the wagering game machine 406 (see discussion of FIG. 3 supra).

Furthermore, any component of the wagering game machine 406 can include hardware, firmware, and/or machine-readable media including instructions for performing the operations described herein.

Example Security Mode Control Device Operating Environment

Figure 5:
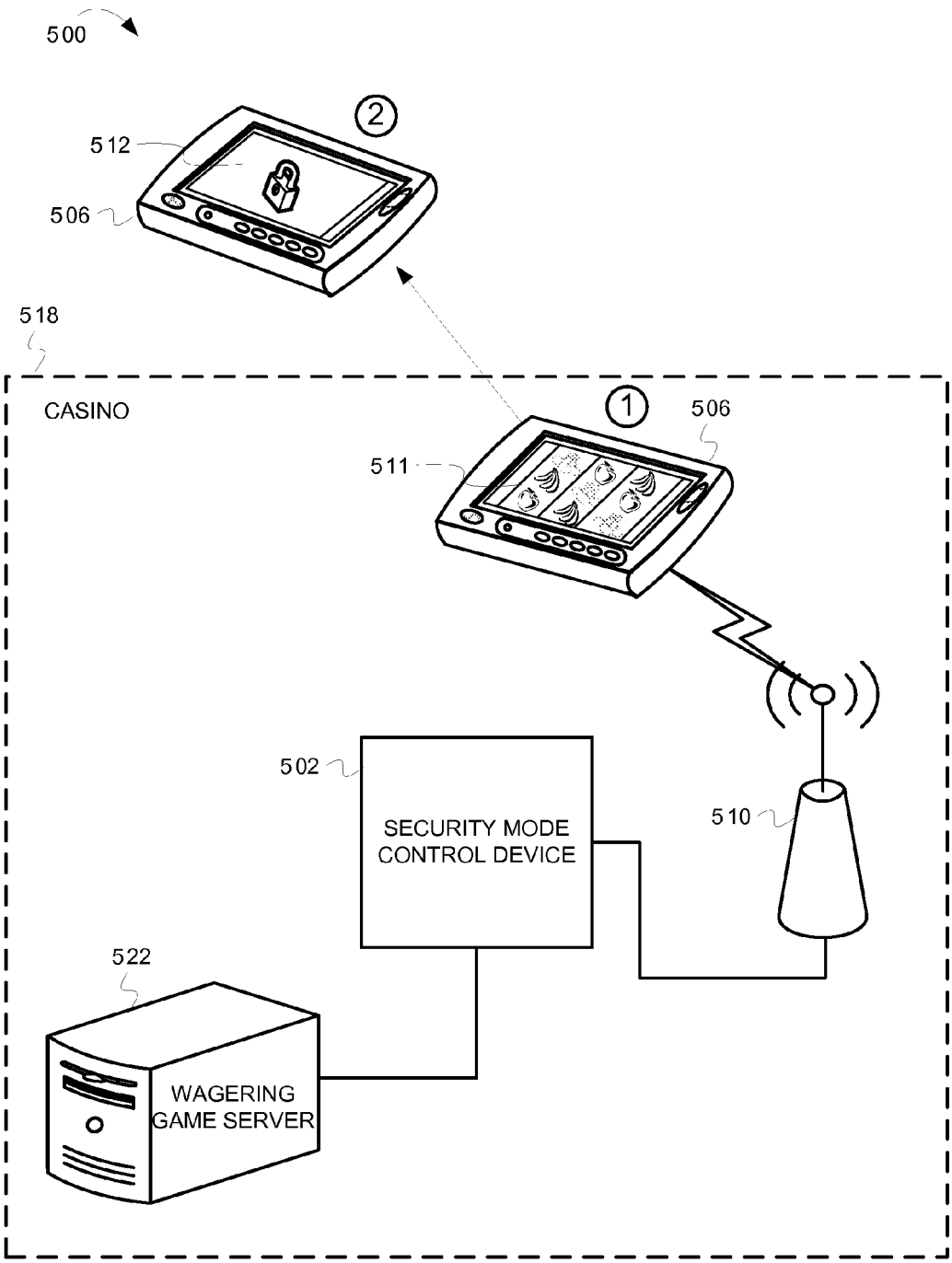
FIG. 5 is an illustration of a security mode control device 502 in an example operating environment 500, according to some embodiments of the invention.

FIG. 5 is an illustration of a security mode control device 502 in an example operating environment 500, according to some embodiments of the invention. In FIG. 5, the security mode control device 502 is connected to a wagering game server 522 ("server") and a wireless access transceiver 510 ("transceiver"). The transceiver 510 communicates with a mobile machine 506. The transceiver 510 can communicate wagering game data, mode commands, environment criteria, account information, etc., between the mobile machine 506 and the server 522. The security mode control device 502 can monitor the location of the mobile machine 506 within a casino 518. At stage "1", the mobile machine 506 is within the casino 518 and is operating a functional mode 511. The functional mode 511 may present wagering games. However, someone or something could move the mobile machine 506 beyond the casino boundaries, as shown at stage "2". The security mode control device 502, however, detects when the mobile machine 506 leaves the casino boundaries. Consequently, the security mode control device 502 can secure the mobile machine 506 by activating a secure mode 512. In some embodiments, the security mode control device 502 can determine levels of security for the secure mode and activate those levels progressively. For instance, the security mode control device 502 could transmit two secure mode commands to the mobile machine 506. The first secure mode command would activate a secure mode that locks the machine to prevent any use of the machine. The second secure mode command, however, could provide a time delayed process that would begin wiping data, software, firmware, etc., from the mobile machine if the machine is not brought back into the casino 518.

If the mobile machine 506 is brought back into the casino, the security mode control device 502 can recognize the mobile machine's presence (e.g., via the transceiver 510). The security mode control device 502 can then send additional secure mode commands to the mobile machine 506 to deactivate the secure mode 512. In other embodiments, the security mode control device 502 could send secure mode commands to maintain the secure mode 512 until an authorized casino employee, such as a floor attendant or a pit boss, entered a key or initiated a valid reactivation sequence.

If, however, the mobile machine 506 did not return to the casino 518, and if no valid key or reactivation sequence were initiated, the security mode control device 502 could cause the mobile machine to activate further secure modes that could wipe data, erase software, disable firmware and destroy hardware.

Example Security Mode Control Device Operating Environment

Figure 6:
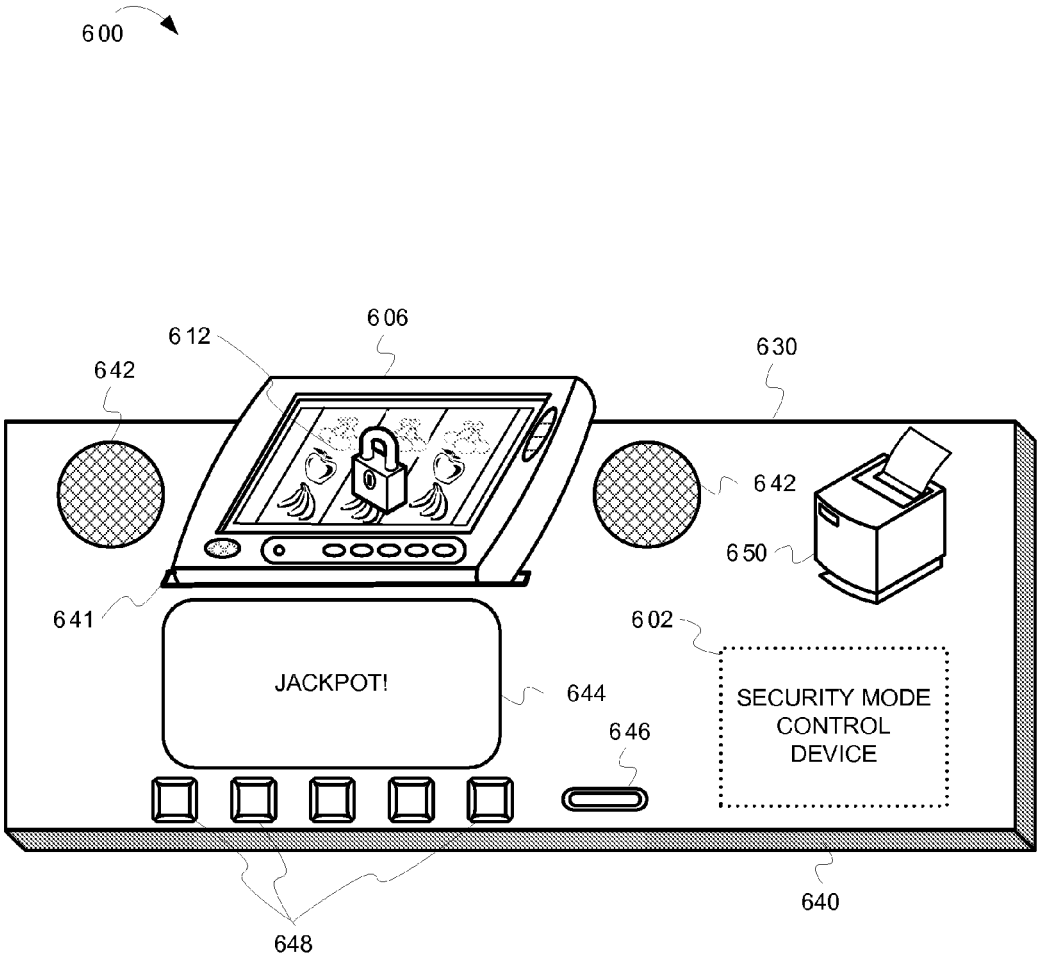
FIG. 6 is an illustration of a security mode control device 602 in an example operating environment 600, according to some embodiments of the invention.

FIG. 6 is an illustration of a security mode control device 606 in an example operating environment 600, according to some embodiments of the invention. In FIG. 6, the security mode control device 602 is interfaced with a docking station 630. The docking station 630 includes a docking port 641 for docking with a mobile machine 606. The docking port 641 can include components for providing power and communications to the mobile machine 606.

The docking station 630 also includes a plurality of input/output devices. In particular, the docking station 630 includes speakers 642, a display 644, buttons 648, a card reader 646, and a voucher printer 650. While some of the input/output devices are shown as being contained within the docking station 630, they can be mounted on or about the docking station 630 at any suitable orientation.

When a mobile machine 606 is docked with the docking station 630 via the docking port 641, the mobile machine 606 can use any of the docking station's input/output devices. For example, the mobile machine 606 can print tickets on the voucher printer 644, present audio on the speakers 642, and present video on the display 644. The mobile machine 606 can also receive input through the buttons 648 and the card reader 646. However, even though the mobile machine 606 is docked, in some embodiments, the mobile machine 606 can still receive input through its own input/output devices.

In one embodiment, the docking station 630 includes pressure sensors and video projectors (not shown) disposed inside the cabinet 640. The pressure sensors can detect when objects touch the top surface of the cabinet 640, while the video projectors can project content onto the top surface of the cabinet. In one embodiment, the docking station 630 projects content onto the top surface of the cabinet 640 in response to detecting objects touching the cabinet 640.

In one embodiment, the docking station 630 includes a security mode control device 602 to control secure modes on the mobile machine 606. The security mode control device 602 can detect a security event, such as a jackpot. The jackpot could be considered a security event because it could require verification of the data, logs, etc. on the mobile machine 606 to ensure that there was no tampering with the mobile machine 606. Consequently, after the jackpot is hit, the security mode control device 602 can enable a secure mode 612 that locks down the function of the mobile machine 606 and secures all necessary data and data elements on the mobile machine 606 until the jackpot can be verified. The voucher printer 650 can be configured to print out any results of the security event, the data on the mobile machine 606, or information provided by the security mode control device 602, such as a log of events, outcomes, etc.

Example Security Mode Control Device Operating Environment

Figure 7:
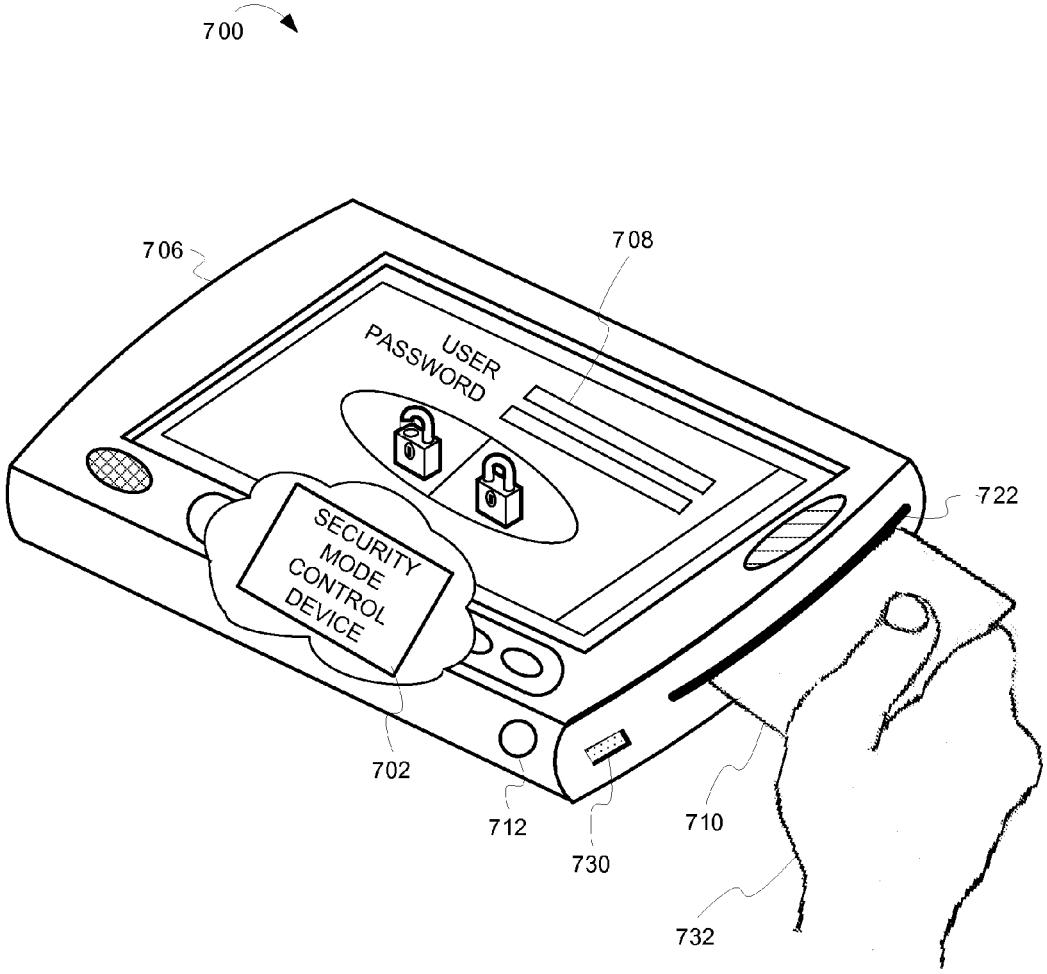
FIG. 7 is an illustration of a security mode control device 702 in an example operating environment 700, according to some embodiments of the invention.

FIG. 7 is an illustration of a security mode control device 702 in an example operating environment 700, according to some embodiments of the invention. In FIG. 7, the security mode control device 702 is contained within the mobile machine 706. The mobile machine 706 includes a mechanism to allow a user to log-on to the machine. In FIG. 7, one mechanism is depicted as a magnetic card reader 722, whereby a user 732 can swipe a card 710 that contains user credentials or other information. Another mechanism is an I/O port 730, whereby a user can connect with a device (e.g., a biometric information device, a key card device, etc.). In another embodiment, another mechanism is a wireless communication device 712. In yet another embodiment, the user may log on to the machine using a log-on console 708, which may prompt for user credentials, such as a network ID and password. In other embodiments, any one of the magnetic card reader 722, I/O port 730, wireless communication device 712, or log-on console 708 can function in concert. Other mechanisms of user log-on and authentication may also be utilized, though not shown.

Once a user has logged on to the mobile machine 706, the security mode control device 702 can manually activate a secure mode to lock the mobile machine 706. The security mode control device 702 can further monitor events and control other secure modes, including preventing secure mode conflicts. For example, the user 732 could be an authorized casino employee that needs to lock the mobile machine 706 to transport the mobile machine 706 beyond casino boundaries. In the gaming industry, it is common for casino personnel to transport mobile machines outside casinos for regulatory inspection. Consequently, when a casino worker carries the mobile machine beyond the casino boundaries, or beyond certain areas of the casino, the security mode control device 702 can recognize the removal of the mobile machine 706. However, the security mode control device 702 knows that the mobile machine 706 is currently in an authorized secure mode and would prevent any escalation of secure modes, thus preventing a secure mode conflict.

The security mode control device 702 can disable the secure mode using a reactivation procedure. In some embodiments, reactivating the mobile machine 706 (i.e., deactivating the secure mode) can be done in stages. For example, while in the secure mode, the mobile machine 706 might be locked completely, so that no one can read or write data on the mobile machine 706. However, the security mode control device 702 could reactivate read capabilities on the mobile machine 706, while still keeping data writing capabilities locked. Therefore, a regulator could inspect the device in a read-only state while the device is outside of the casino. Later, when the device is back within the casino, the device could be unlocked entirely for reading and writing data.

Example Security Mode Control Device Example Operating Environment

Figure 8:
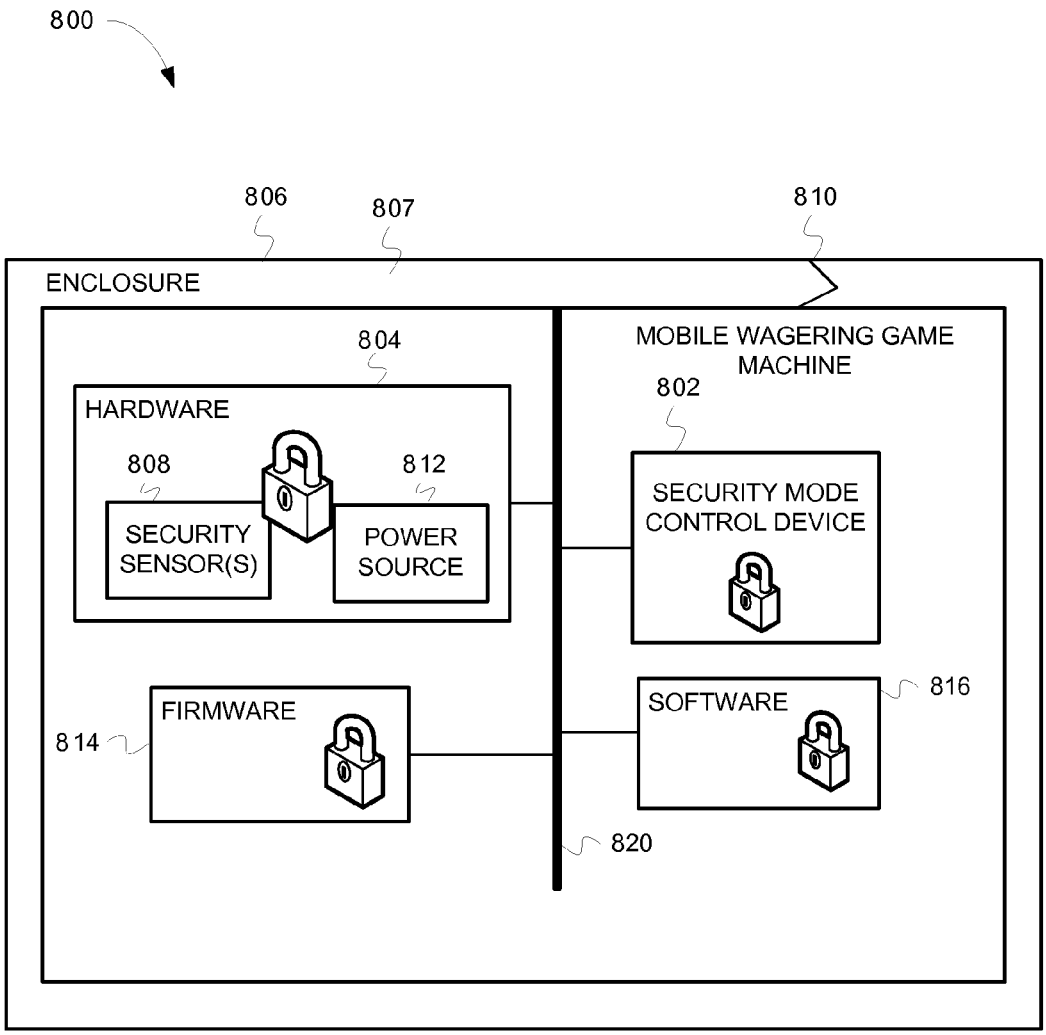
FIG. 8 is an illustration of a security mode control device 802 in an example operating environment 800, according to some embodiments of the invention.

FIG. 8 is an illustration of a security mode control device 802 in an example operating environment 800, according to some embodiments of the invention. In FIG. 8, a mobile machine 806 includes a security mode control device 802. The mobile machine 806 includes hardware 804, software 816, firmware 814, and an enclosure 807. An internal communication interface 820 can facilitate communication between elements in the security mode control device 802.

The hardware 804 includes the physical elements of a mobile machine, as shown in FIG. 4. The software 816 includes wagering game software, operating system software, etc. The firmware 814 includes a BIOS, Flash RAM, NOV RAM, etc. The enclosure 807 includes a protective casing for the mobile machine. The enclosure 807 can be connected to security sensors 808 that can detect when the enclosure 807 has been tampered with, like a crack 810 in the enclosure 807. The mobile machine 806 can include internal sub-systems, or be attached to external systems and devices, with their own hardware, software and firmware. The security mode control device 802 can function in conjunction with those internal sub-systems and external systems and devices to secure the mobile machine 806. For example, the mobile machine 806 could contain a shell (not shown) that contains its own hardware, software, firmware, and security devices. The security mode control device 806 can function in conjunction with shell security devices to secure the mobile machine 806 by erasing, modifying, locking or destroying the hardware, software, and firmware in the shell.

In some embodiments, the security mode control device 802 can detect a severe security event, like physical tampering, such as the crack 810 in the enclosure 807. The security mode control device 802 can activate a secure mode that can wipe out all, or select parts, of the data, software, firmware, etc. The security mode control device 802 can also disable and destroy hardware 804. The security mode control device 802 can also disable or destroy itself.

Example Mobile Wagering Game Machine

Figure 13:
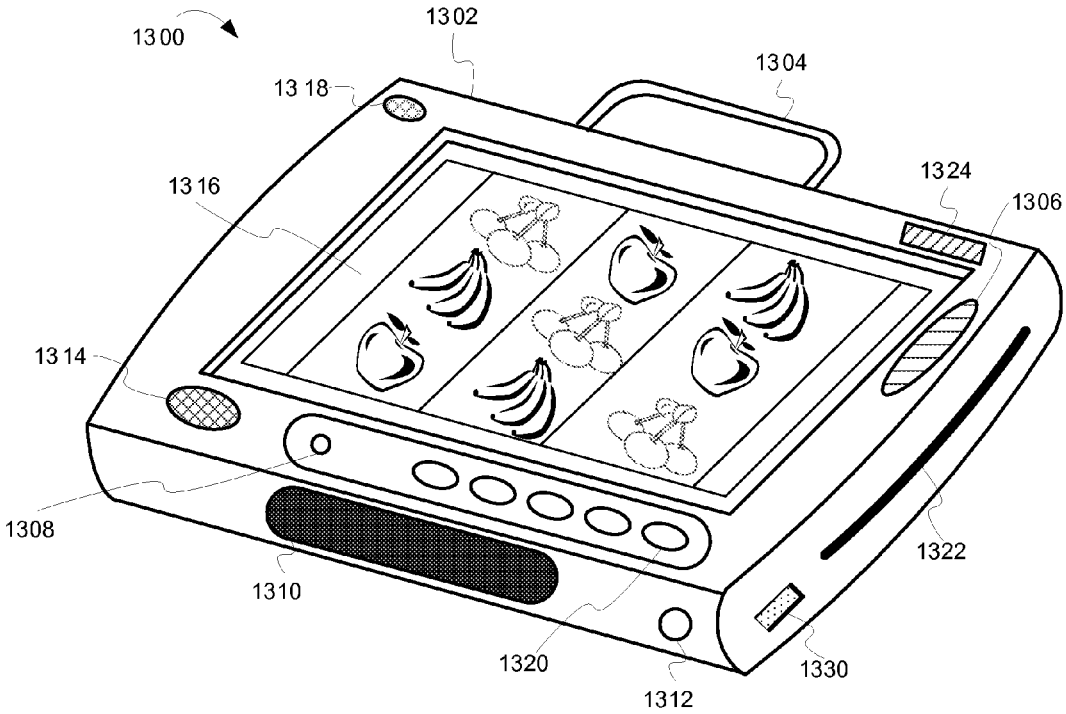
FIG. 13 is an illustration of a mobile wagering game machine 1300, according to some embodiments of the invention.

FIG. 13 is an illustration of a mobile wagering game machine 1300, according to some embodiments of the invention. In FIG. 13, the mobile wagering game machine 1300 includes a housing 1302 for containing internal hardware and/or software such as that described above vis-à-vis FIG. 4. In one embodiment, the housing has a form factor similar to a tablet PC, while other embodiments have different form factors. For example, the mobile wagering game machine 1300 can exhibit smaller form factors, similar to those associated with personal digital assistants. In one embodiment, a handle 1304 is attached to the housing 1302. Additionally, the housing can store a foldout stand 1310, which can hold the mobile wagering game machine 1300 upright or semi-upright on a table or other flat surface.

The mobile wagering game machine 1300 includes several input/output devices. In particular, the mobile wagering game machine 1300 includes buttons 1320, audio jack 1308, speaker 1314, display 1316, biometric device 1306, wireless transmission devices 1312 and 1324, microphone 1318, and card reader 1322. Additionally, the mobile wagering game machine can include tilt, orientation, ambient light, or other environmental sensors.

In one embodiment, the mobile wagering game machine 1300 uses the biometric device 1306 for authenticating players, whereas it uses the display 1316 and speakers 1314 for presenting wagering game results and other information (e.g., credits, progressive jackpots, etc.). The mobile wagering game machine 1300 can also present audio through the audio jack 1308 or through a wireless link such as Bluetooth.

In one embodiment, the wireless communication unit 1312 can include infrared wireless communications technology for receiving wagering game content while docked in a wager gaming station. The wireless communication unit 1324 can include an 802.11G transceiver for connecting to and exchanging information with wireless access points. The wireless communication unit 1324 can include a Bluetooth transceiver for exchanging information with other Bluetooth enabled devices.

In one embodiment, the mobile wagering game machine 1300 is constructed from damage resistant materials, such as polymer plastics. Portions of the mobile wagering game machine 1300 can be constructed from non-porous plastics which exhibit antimicrobial qualities. Also, the mobile wagering game machine 1300 can be liquid resistant for easy cleaning and sanitization.

In some embodiments, the mobile wagering game machine 1300 can also include an input/output ("I/O") port 1330 for connecting directly to another device, such as to a peripheral device, a secondary mobile machine, etc. Furthermore, any component of the mobile wagering game machine 1300 can include hardware, firmware, and/or machine-readable media including instructions for performing the operations described herein.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 9:
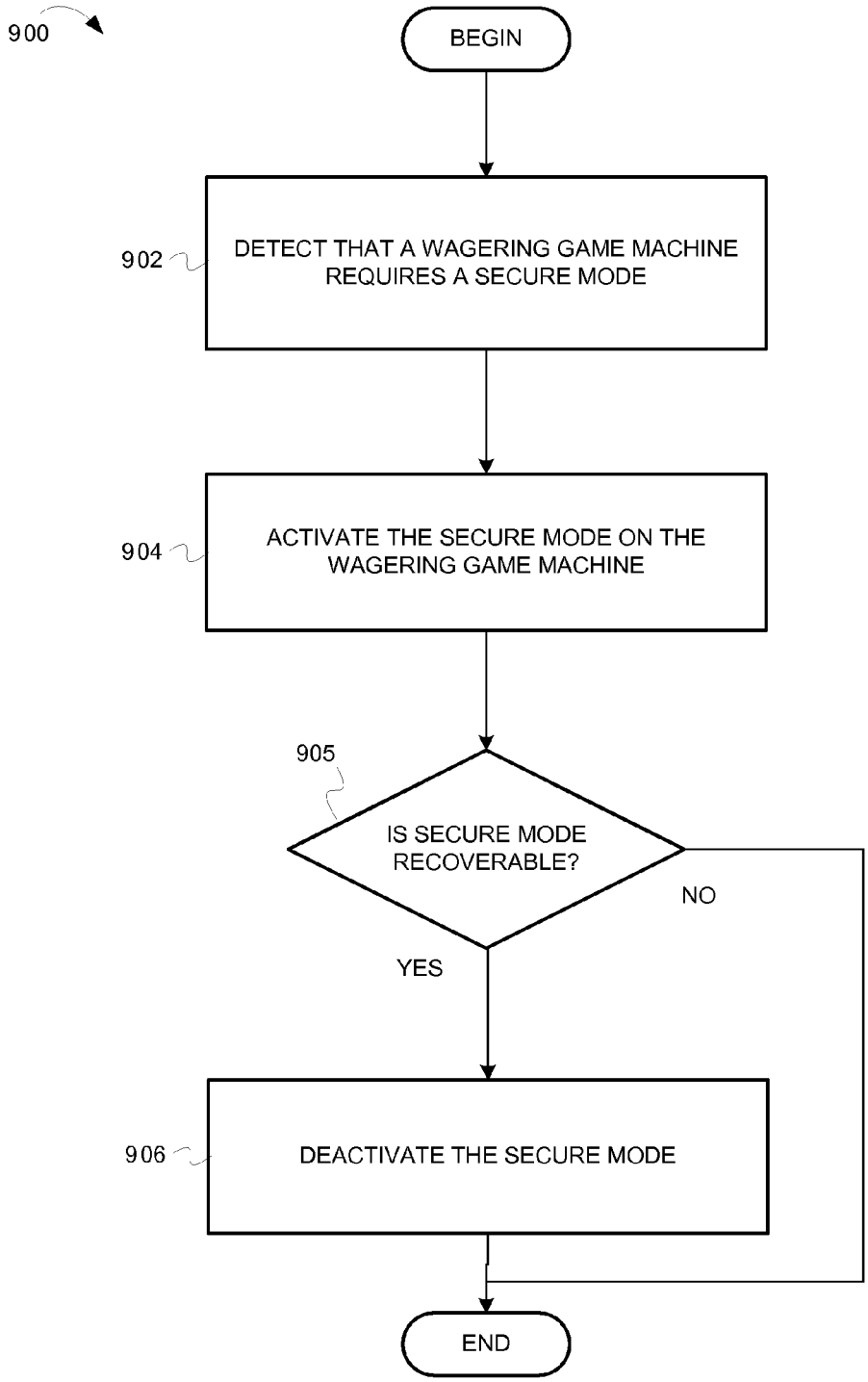
FIG. 9 is a flow diagram 900 illustrating securing a wagering game machine, according to some embodiments of the invention.

FIG. 9 is a flow diagram illustrating securing a wagering game machine, according to some embodiments of the invention. In FIG. 9, the flow 900 begins at processing block 902, where a security mode control device detects that a wagering game machine requires a secure mode. The security mode control device can detect an event that occurs on the wagering game network. In some embodiments, the event is classifiable by a severity type indicating a degree of needed security. For example, the security event may be minor, such as a locking procedure that an authorized user manually initiates. In other embodiments, the security event may be severe, such as physical tampering with the mobile machine. Based on the severity of the security event, the security mode control device can determine a security level of the secure mode. The security mode control device can then activate the secure mode based on the security level.

In FIG. 9, the flow 900 continues at processing block 904, where the security mode control device activates the secure mode on the wagering game machine. Several types of secure modes can exist, ranging in severity from recoverable to unrecoverable. The security mode control device activates the secure mode to prevent one or more wagering game functional modes on the wagering game machine. A functional mode can include an operational mode that allows the operation of wagering game computer programs. While activating a secure mode on the wagering game machine, the security mode control device can (1) prevent the wagering game machine from writing and generating data, (2) erase data on the wagering game machine, (3) erase software and firmware on the wagering game machine; (4) disable or destroy hardware on the wagering game machine; and (5) provide environmental cues. In some embodiments, the secure mode control device can give environmental cues, such as visual indicators of tampering, audible tones, flashing lights, etc., when an unauthorized person opens or tampers with the wagering game machine. The security mode control device can also transfer wagering game data from the wagering game machine to a network device, like a wagering game server. To activate secure modes, the security mode control device can generate secure mode control commands and communicate the secure mode control command to the wagering game machine In FIG. 9, the flow 900 continues at processing block 906, where the security mode control device determines whether the secure mode can be deactivated. If the secure mode cannot be deactivated, the process can end. However, if the secure mode can be deactivated, the process can continue.

In FIG. 9, the flow 900 continues at processing block 908, where the security mode control device disables, or deactivates, the secure mode. The secure mode control device can deactivate the secure mode to re-enable or reactivate one or more wagering game functional modes.

Figure 10:
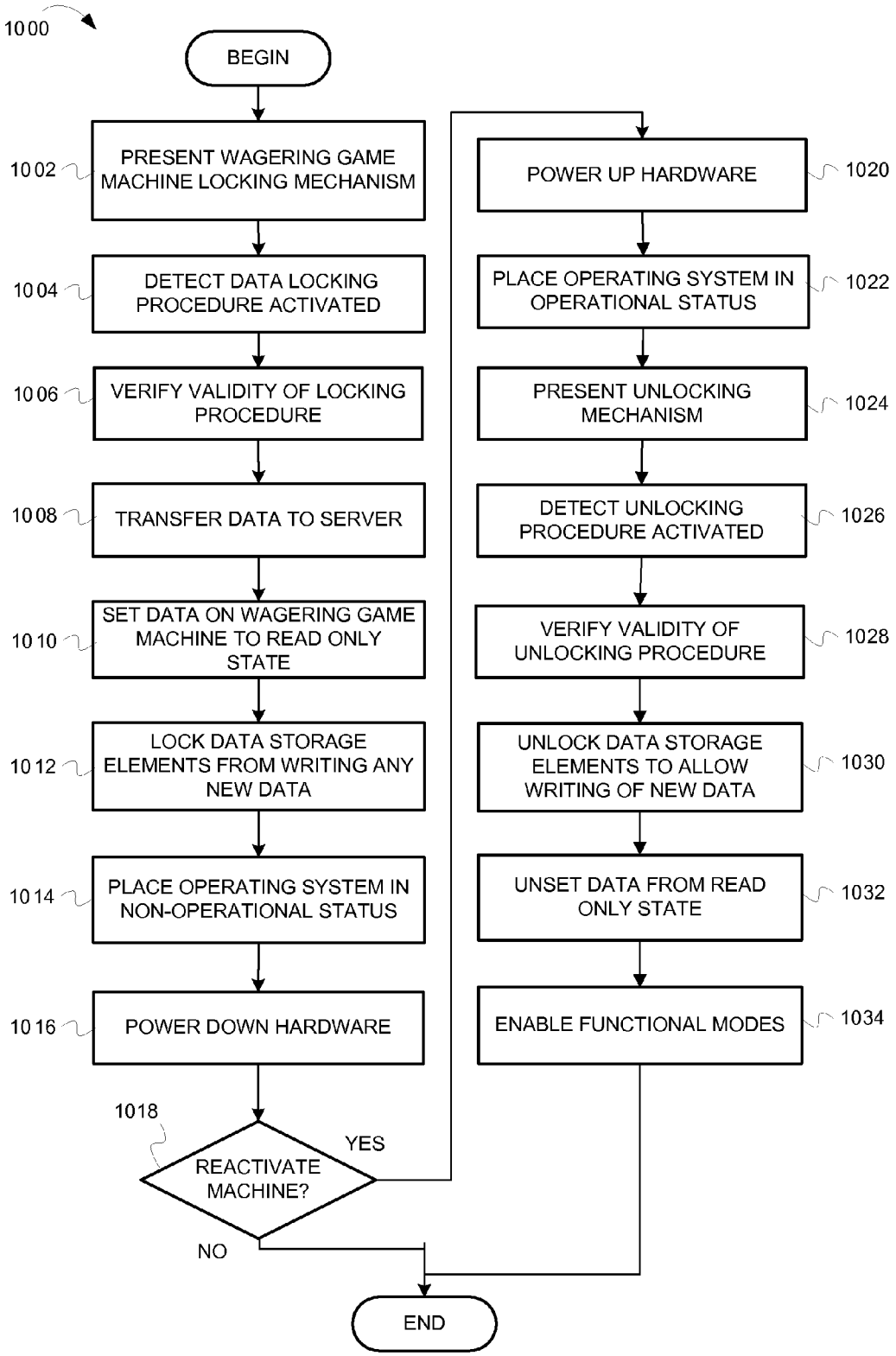
FIG. 10 is a flow diagram 1000 illustrating securing a wagering game machine, according to some embodiments of the invention.

FIG. 10 is a flow diagram illustrating securing a wagering game machine, according to some embodiments of the invention. In FIG. 10, the flow 1000 begins at processing block 1002, where a security mode control device presents a wagering game machine locking mechanism. The locking mechanism can be a login display, a magnetic card swipe, a key card port, etc. In some embodiments, the locking mechanism can present a locking screen prompting a user for a login id and password.

In FIG. 10, the flow 1000 continues at processing block 1004, where the security mode control device detects that a locking procedure has been activated. For example, the security mode control device can detect when a user manually initiates a locking process. A locking process can include selecting a key or button combination on the wagering game machine.

In FIG. 10, the flow 1000 continues at processing block 1006, where the security mode control device verifies the validity of the locking procedure. A user can enter user credentials (e.g., User ID, password, etc.). The security mode control device can validate or authenticate the user.

In FIG. 10, the flow 1000 continues at processing block 1008, where the security mode control device transfers data to a wagering game server. In some embodiments, the security mode control device can make a full or partial image of the data on the machine onto the server, if time permits. In other embodiments, the security mode control device can periodically upload data from the wagering game machine to a wagering game server.

In FIG. 10, the flow 1000 continues at processing block 1010, where the security mode control device sets data on the wagering game machine to a read-only state. The data can be information about wagering games and wagering game related activity. Specifically, the data can include information about winnings, losses, etc. Therefore, the data cannot be tampered with while the machine is locked in the secure mode.

In FIG. 10, the flow 1000 continues at processing block 1012, where the security mode control device locks data storage elements from writing any new data. The security mode control device can also prevent reading or modifying existing data on the wagering game machine.

In FIG. 10, the flow 1000 continues at processing block 1014, where the security mode control device places the wagering game machine's operating system into a non-operational status.

In FIG. 10, the flow 1000 continues at processing block 1016, where the security mode control device powers down hardware. The security mode control device turns off power to hardware elements on the wagering game machine that do not require power during non-operational status. In some embodiments, the security mode control device places a wagering game machine in a standby mode, whereby only enough power is consumed by the hardware to maintain data in a read-only state.

In FIG. 10, the flow 1000 continues at processing block 1018, where the security mode control device determines whether the wagering game machine should be reactivated. The security mode control device can determine if the secure mode is recoverable. A recoverable mode is an operational mode that allows the wagering game machine can to return to a functional state.

In FIG. 10, the flow 1000 continues at processing block 1020, where the security mode control device powers up the wagering game machine's hardware.

In FIG. 10, the flow 1000 continues at processing block 1022, where the security mode control device places the wagering game machine's operating system in operational status.

In FIG. 10, the flow 1000 continues at processing block 1024, where the security mode control device presents an unlocking mechanism, such as a logout screen, a key card entry or magnetic card swipe, etc.

In FIG. 10, the flow 1000 continues at processing block 1026, where the security mode control device detects that a user initiates an unlocking procedure.

In FIG. 10, the flow 1000 continues at processing block 1028, where the security mode control device verifies validity of unlocking procedure. In some embodiments, verifying the validity of an unlocking procedure can include checking the authority of the user against a user credential store.

In FIG. 10, the flow 1000 continues at processing block 1030, where the security mode control device unlocks data storage elements to allow writing of new data.

In FIG. 10, the flow 1000 continues at processing block 1032, where the security mode control device unsets data from a read-only state.

In FIG. 10, the flow 1000 continues at processing block 1034, where the security mode control device enables functional modes. The security mode control device allows the device to return to full or limited activation status. For example, if an inspector needs to inspect a device, the security mode control device may only have to reactivate a mobile machine to a read-only state. Full functionality does not need to be restored. On the other hand, a security mode control device can unlock the secure mode so that the machine can be fully functional again.

Figure 11:
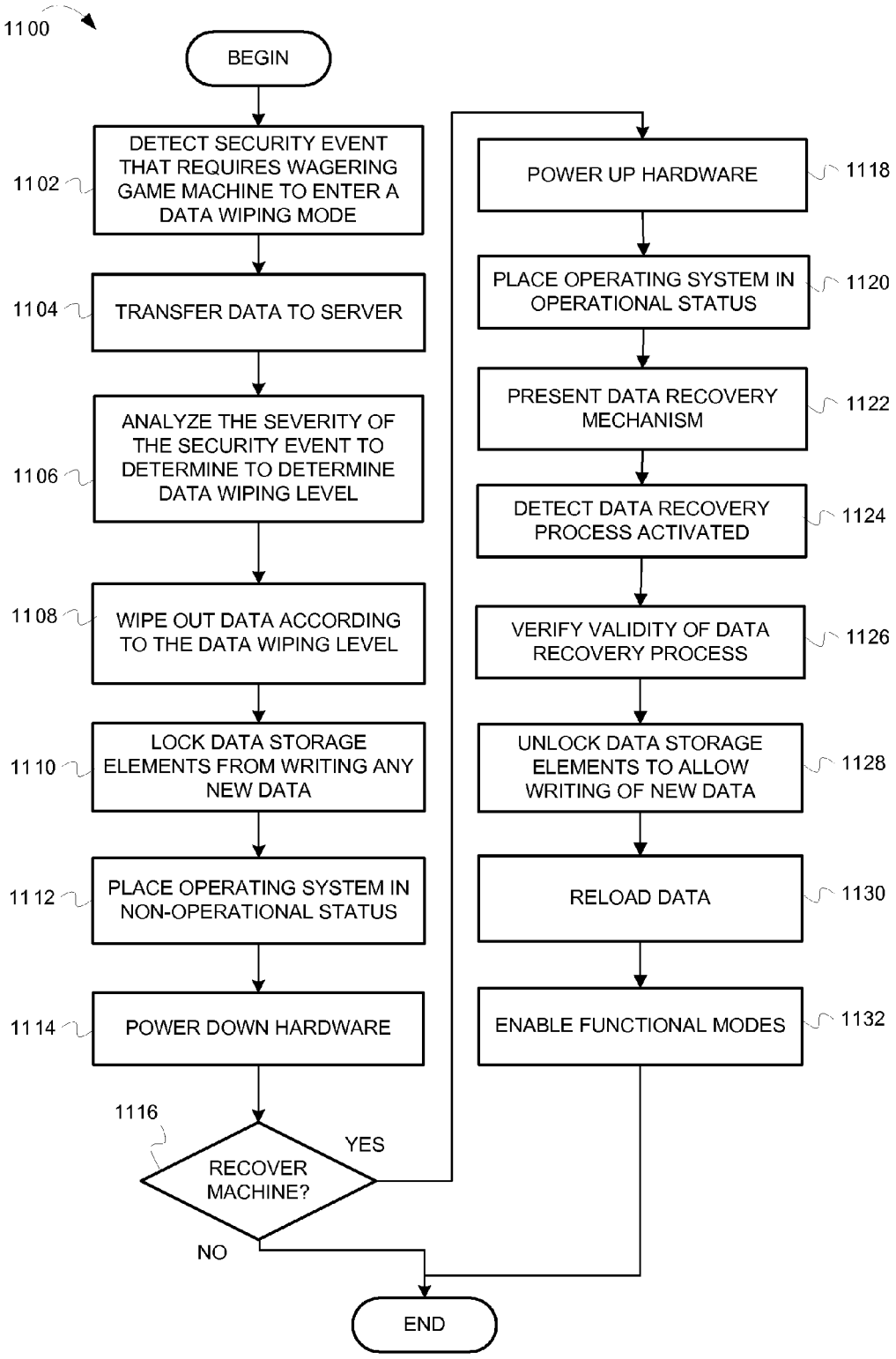
FIG. 11 is a flow diagram 1100 illustrating securing a wagering game machine, according to some embodiments of the invention.

FIG. 11 is a flow diagram illustrating securing a wagering game machine, according to some embodiments of the invention. In FIG. 11, the flow 1100 begins at processing block

1102, where a security mode control device detects a security event that requires a wagering game machine to enter a data wiping mode.

In FIG. 11, the flow 1100 continues at processing block 1104, where the security mode control device transfers data to a network device, like a wagering game server ("server"). In some embodiments, the wagering game machine can provide the server with data on a periodic basis. Before activating any secure modes, therefore, the security mode control device can make a final data transfer. In other embodiments, the security mode control device can image the data on the wagering game machine onto a hard drive on the server.

In FIG. 11, the flow 1100 continues at processing block 1106, where the security mode control device analyzes the severity of the security event to determine a data wiping level. In some embodiments, the security event might be severe enough that all of the data on the wagering game machine needs to be wiped, or erased. In those embodiments, the data wiping level would be high. In other embodiments, however, the security event might be only moderately severe. Therefore, in those embodiments, the data wiping level would be lower. Therefore, the security mode control device would not need to wipe all of the data on the wagering game machine.

In FIG. 11, the flow 1100 continues at processing block 1108, where the security mode control device wipes data according to the data wiping level. In some embodiments, the security mode control device will wipe out some data. That data can be associated with software, any user-specific information, logs, software applications, caches and short term memory, memory, some data associated with firmware and firmware, etc. The security mode control device can wipe the data on all components of machine that may contain data. However, in some embodiments, the security mode control device leaves a sufficient operational framework intact, or in other words, does not wipe-out the operating system, firmware, etc. of the wagering game machine. Therefore, the security mode control device can enable some recovery of use on the wagering game machine.

In FIG. 11, the flow 1100 continues at processing block 1110, where the security mode control device locks data storage elements from writing any new data. The security mode control device prevents a user or a device from writing new data—especially data that can relate to wagering games. The security mode control device can also prevent reading and modification of already existing data on the wagering game machine.

In FIG. 11, the flow 1100 continues at processing block 1112, where the security mode control device places the operating system in non-operational status. Non-operational status can be stand-by modes, shut-down modes, locked modes, etc.

In FIG. 11, the flow 1100 continues at processing block 1114, where the security mode control device powers down hardware. The security mode control device turns off power to most hardware elements on the device that do not require power during non-operational status. In some embodiments, the security mode control device leaves power on to the communication devices sufficient to communicate with a server if the device returns to communication range. The security mode control device can prevent unauthorized communication with servers by using encrypted communication techniques.

In FIG. 11, the flow 1100 continues at processing block 1116, where the security mode control device determines whether the secure mode can be deactivated, and the wagering game machine can be recovered for continued use. In some embodiments, recovery is possible if the security mode control device left a sufficient operational framework intact. In other embodiments, if the security mode control device removes all operational framework, the machine may still be recoverable, but the operational framework would need to be reloaded and reinitialized. If recovery is possible, the process continues. If no recovery is possible, such as if an external security event occurred that destroyed hardware, or if excessive tampering had occurred to the wagering game machine, the process ends.

In FIG. 11, the flow 1100 continues at processing block 1118, where the security mode control device powers up hardware. The security mode control device turns on power to most hardware elements on the device that require power during operational status.

In FIG. 11, the flow 1100 continues at processing block 1120, where the security mode control device places the operating system in operational status.

In FIG. 11, the flow 1100 continues at processing block 1122, where the security mode control device presents a data recovery mechanism. In some embodiments, the security mode control device can present a display screen to a user to initiate data recovery. The user can initiate the data recovery by using an authorization entry (key code, user id and password, etc.).

In FIG. 11, the flow 1100 continues at processing block 1124, where the security mode control device detects that the data recovery process has been activated.

In FIG. 11, the flow 1100 continues at processing block 1126, where the security mode control device verifies validity of data recovery process. If the data recovery mechanism required an authorization entry, the security mode control device can verify that authorization entry. In some embodiments, the security mode control device has an authentication store included, and can verify authorization entries with the authentication store. In some embodiments, the security mode control device can communication with an external device, like a server, to verify authorization entries.

In FIG. 11, the flow 1100 continues at processing block 1128, where the security mode control device unlocks data storage elements to allow writing of new data. The security mode control device can also unlock data storage elements to allow for reading and modification of existing data.

In FIG. 11, the flow 1100 continues at processing block 1130, where the security mode control device reloads data. For example, the security mode control device could communicate with an external data loading source, like a wagering game server. If the wagering game server has data or an image of data, it can load that data onto the wagering game machine. The amount of data loaded onto the machine will enable some degree of recovery of use. If some hardware was destroyed or tampered with by external sources, then hardware could be repaired or replaced. The security mode control device could then indicate to the data loading source to require reinitialization of data, reinstall of software, etc, into a data framework, such as to a manufacturing default state.

In FIG. 11, the flow 1100 continues at processing block 1132, where the security mode control device enables functional modes. Functional modes can include any kind of operational modes that allows a casino user to use the wagering game machine.

Figure 12:
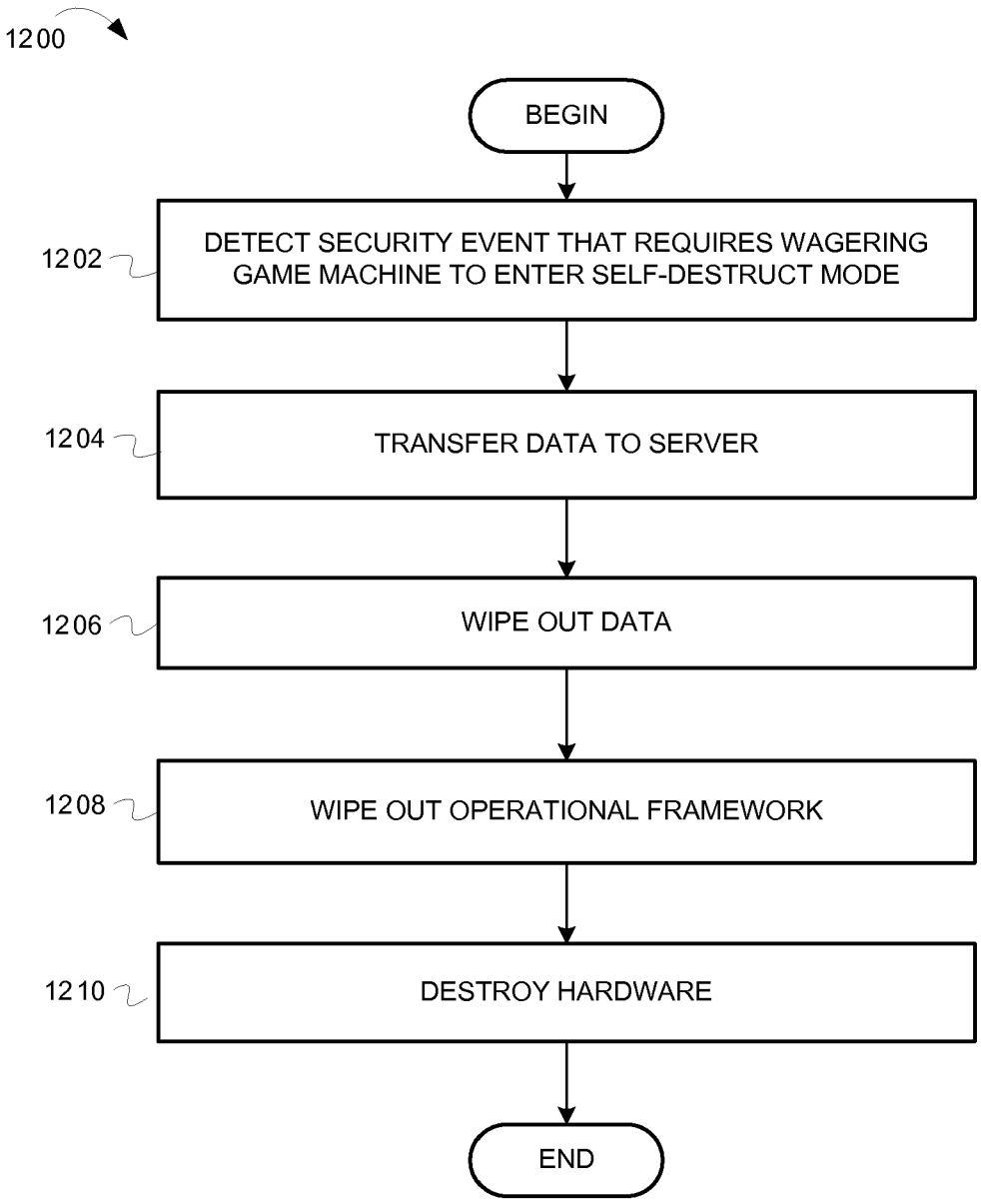
FIG. 12 is a flow diagram 1200 illustrating securing a wagering game machine, according to some embodiments of the invention.

FIG. 12 is a flow diagram illustrating securing a wagering game machine, according to some embodiments of the invention. In FIG. 12, the flow 1200 begins at processing block 1202, where a security mode control device detects a security event that requires a wagering game machine to enter a self-destruct mode. Some security events can be very severe, like when a mobile machine leaves a casino without authorization or when a mobile machine is intentionally damaged. The security mode control device can detect when an event is severe by comparing the detected security event to a rules store regarding security events. The rules store can include possible degrees of severity for security events. Based on the degrees of severity for the security events, the security mode control device can then determine what level of security to activate. Thus, the security mode control device can determine an appropriate secure mode to activate. One possible secure mode with a high level of security is a self destruction mode.

In FIG. 12, the flow 1200 continues at processing block 1204, where the security mode control device transfers data to a server. In some embodiments, security mode control device can send data to a wagering game server on a periodic basis. The security mode control device can make a final data transfer. In other embodiments, the security mode control device can image the data on the wagering game machine onto a hard drive on the server. However, if time is limited, the security mode control device can limit the data transfer in favor of other processing described below.

In FIG. 12, the flow 1200 continues at processing block 1206, where the security mode control device wipes out as much data as possible on the wagering game machine. The security mode control device can wipe out data associated with software, any user specific information, logs, software applications, caches and short term memory, memory, some data associated with firmware and firmware, etc. The security mode control device can wipe the data in an intelligent, progressive pattern. For example, the security mode control device can wipe the most critical data first, which could be data relating directly to wagering games. The security mode control device can then wipe data that relates to software or proprietary data that would require the most protection from manipulation, theft or piracy. The security mode control device can then continue with wiping other data, software, memory, RAM, and so on.

In FIG. 12, the flow 1200 continues at processing block 1208, where the security mode control device wipes out operational framework. The security mode control device can wipe out the operating system, firmware, etc. The framework is related to the operation of a machine, not necessarily to user specific data. However, the framework can be proprietary, and consequently the owner could suffer harm if the embedded code or framework design were discovered or reverse engineered. To prevent any chance of discovery or reverse engineering, the security mode control device deletes the framework.

In FIG. 12, the flow 1200 continues at processing block 1210, where the security mode control device destroys hardware. In some embodiments, the security mode control device could destroy certain portions of the hardware elements on the machine sufficient to turn the machine into a mass of unusable, unreadable components. Recovery might be possible only if hardware was repaired or replaced. In other embodiments, the security mode control device could destroy hardware elements to such a degree that recovery would not be possible or practical. In some embodiments, a mobile wagering game machine contains a shell. The shell can contain data, software, firmware, hardware, etc. The security mode control device can function in conjunction with shell security devices to secure the wagering game machine.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

determining a wireless casino network in a casino for a mobile wagering game machine, wherein the wireless casino network includes a boundary, and wherein the mobile wagering game machine is configured to provide wagering game functionality only within the boundary, wherein the mobile wagering game machine is configured to enable one or more wagering game modes that cause generation of wagering game data;

determining a location of the mobile wagering game machine;

determining that the mobile wagering game machine leaves the boundary of the wireless casino network;

activating the one or more secure modes on the mobile wagering game machine based on severity of activity that occurs to the mobile wagering game machine outside of the boundary, the one or more secure modes configured to protect the wagering game data;

transferring, wirelessly, via one or more processors, an image of the wagering game data from the mobile wagering game machine to a network device;

erasing, via at least one of the one or more processors, the wagering game data from the mobile wagering game machine after the mobile wagering game machine leaves the boundary;

determining, via at least one of the one or more processors, that the mobile wagering game machine reenters the boundary;

receiving, wirelessly, via at least one of the one or more processors, the wagering game data from the network device, in response to determining that the mobile wagering game machine reenters the boundary; and restoring, wirelessly, via at least one of the one or more processors, the image of the wagering game data on the mobile wagering game machine in response to receiving the wagering game data.

2. The method of claim 1, wherein activating the one or more secure modes comprises activating the one or more secure modes based on time that the mobile wagering game machine remains outside the boundary.

3. The method of claim 1, wherein activating the one or more secure modes comprises determining levels of severity of the activity, and activating the one or more secure modes in a progressive pattern according to severity of the activity.

4. The method of claim 3, further comprising:

determining data wiping levels for one or more of wagering game data, gaming software data, and operational framework data on the mobile wagering game machine, wherein the levels of data wiping correlate to the levels of severity, wherein the operational framework data consists of one or more of an operating system and firmware of the mobile wagering game machine; and erasing, first the one or more of the wagering game data, second the gaming software data, and third the operational framework data on the mobile wagering game machine according to the data wiping levels.

5. The method of claim 3, wherein activating the one or more secure modes in the progressive pattern according to severity of the activity includes performing, in series, first one or more of preventing the mobile wagering game machine from writing and generating new wagering game data and erasing data on the mobile wagering game machine, and, second, disabling hardware on the mobile wagering game machine.

6. The method of claim 1, wherein activating the one or more secure modes further comprises, determining an authorization for the mobile wagering game machine to leave the boundary, restricting data modification on the mobile wagering game machine while outside of the boundary, and preventing activation of a secure mode that erases the wagering game data.

7. The method of claim 1 further comprising:

determining that the mobile wagering game machine receives an authorization to deactivate the one or more secure modes; and deactivating the one or more secure modes according to the authorization in stages.

8. A system comprising:

at least one input device configured to receive an indication of a wager to play a wagering game;

at least one display device configured to display the wagering game;

at least one processor; and at least one memory device storing instructions which, when executed by the at least one processor, cause the system to determine that an event occurs on a wagering game network, wherein the event indicates a need to activate one or more secure modes of a wagering game machine, activate the one or more secure modes, wherein activation of the one or more secure modes deactivates wagering game functionality of the wagering game machine in response to the event to prevent writing of additional wagering game data via the wagering game machine, transfer an image of stored wagering game data from the wagering game machine to a wagering game server in response to the event, erase the stored wagering game data from the wagering game machine in response to the event, determine that the event no longer indicates a need for the wagering game machine to activate the one or more secure modes, and restore the image of the stored wagering game data from the wagering game server to the wagering game machine to automatically restore the wagering game functionality in response to determination that the event no longer indicates the need for the wagering game machine to activate the one or more secure modes.

9. The network-system of claim 8, wherein the instructions, when executed by the at least one processor, further cause the system to, determine a severity level for the event, deactivate one or more of a plurality of operational modes for the wagering game machine according to the severity level of the event, determine that the event no longer indicates a need to for the wagering game machine to activate the one or more secure modes, and reactivate the one or more of the plurality of operational modes for the wagering game machine.

10. The system of claim 8, wherein the wagering game machine is a mobile machine, and wherein the instructions, when executed by the at least one processor, further configured cause the system to, connect to a wireless casino network for the mobile machine, wherein the wireless casino network includes a boundary, and wherein the mobile machine is configured to provide wagering game functionality only within the boundary, wherein the mobile machine is configured to enable one or more wagering game modes that cause generation of wagering game data;

determine a location of the mobile machine;

determine that the mobile machine leaves the boundary of the wireless casino network; and activate the one or more secure modes on the mobile machine based on severity of activity that occurs to the mobile machine outside of the boundary, the one or more secure modes configured to protect the wagering game data.

11. The system of claim 8, wherein the event is classifiable by a severity type indicating a degree of needed security, and wherein the instructions, when executed by the at least one processor, further cause the system to determine the severity type of the event and activate the one or more secure modes according to one or more levels of security that correspond with the severity type.

12. The system of claim 8, wherein the instructions, when executed by the at least one processor, further cause the system to secure electronic information on the wagering game machine, including locking and erasing one or more of data, software, firmware, memory, bios configurations, operating systems, system configurations, and files.

13. The system of claim 8, wherein the instructions, when executed by the at least one processor, further cause the system to present an authorization mechanism to deactivate the one or more secure modes, receive authorization information via the authorization mechanism, validate the authorization information, and deactivate the one or more secure modes.

14. One or more non-transitory machine-readable storage media having instructions stored thereon, which when executed by a set of one or more processors causes the set of one or more processors to perform operations comprising:

determining that a mobile wagering game machine leaves a boundary of a casino;

activating a first command on the mobile wagering game machine, in response to the mobile wagering game machine leaving the boundary, said first command to activate a first secure mode that locks the mobile wagering game machine to prevent use of the mobile wagering game machine;

activating a second command on the mobile wagering game machine, in response to the mobile wagering game machine leaving the boundary, said second command to activate a second secure mode with a time delay to erase data stored on the mobile wagering game machine in a progressive pattern if the mobile wagering game machine does not return to the boundary within a time period.

15. The one or more non-transitory machine-readable storage media of claim 14, said operations further comprising:

determining that the mobile wagering game machine does not return to the boundary within the time period; and erasing the data on the mobile wagering game machine according to a data wiping level based on a degree of severity for activity that occurs to the mobile wagering game machine outside of the boundary, wherein the data wiping level deletes at least one of a plurality of types of data, wherein deletion of a first of the plurality of types the mobile wagering game machine does not permanently disable the mobile wagering game machine, and wherein deletion of a second of the plurality of types of data the mobile wagering game machine permanently disables the mobile wagering game machine.

16. The one or more non-transitory machine-readable storage media of claim 14, said operations further comprising activating a third command to detect physical tampering with an enclosure of the mobile wagering game machine and destroy hardware on the mobile wagering game machine in response to detection of the physical tampering with the enclosure.

17. The one or more non-transitory machine-readable storage media of claim 14, said operations further comprising:

transferring an image of at least a portion of the data to a network device before erasure of the data;

erasing the data after the time period;

determining that the mobile wagering game machine is secured; and receiving an authorization to reload the image of the at least a portion of the data from the network device to the mobile wagering game machine in response to determining that the mobile wagering game machine is secured.

18. The one or more non-transitory machine-readable storage media of claim 14, wherein erasing the amount of data in the progressive pattern comprises first, erasing one or more of user related data on the mobile wagering game machine and wagering game software stored on the wagering game machine and, second, erasing one or more of an operating system and firmware of the mobile wagering game machine.

19. The one or more non-transitory, machine-readable storage media of claim 14, said operations further comprising preventing erasure of an operating system of the mobile wagering game machine.

20. One or more non-transitory machine-readable storage media having instructions stored thereon, which when executed by a set of one or more processors causes the set of one or more processors to perform operations comprising:

transferring an image of data stored on a wagering game machine;

erasing the data from the wagering game machine in response to an event that indicates a need to secure the wagering game machine;

determining that the wagering game machine is secured;

accessing the image of the data in response to determination that the wagering game machine is secured; and restoring the image of the data to the wagering game machine in response to access of the image of the data.

21. The one or more non-transitory machine-readable storage media of claim 20, wherein the wagering game machine is a mobile device, wherein the event indicates that the wagering game machine leaves a boundary of a casino, and wherein the operation for determining that the wagering game machine is secured includes one or more operations comprising determining that the wagering game machine returns to the boundary of the casino.

22. The one or more non-transitory machine-readable storage media of claim 21 wherein the operations further comprise determining that the wagering game machine fails to return to the boundary within a given time, and wherein the operation for erasing the data is in response to the wagering game machine failing to return to the boundary within the given time.

23. The one or more non-transitory machine-readable storage media of claim 20, wherein the operation for erasing the data from the one or more memory devices associated with the wagering game machine includes one or more operations comprising erasing the data in a progressive pattern.

* * * * *